US006210311B1

(12) United States Patent
May

(10) Patent No.: US 6,210,311 B1
(45) Date of Patent: Apr. 3, 2001

(54) TURBINE DRIVEN CENTRIFUGAL FILTER

(75) Inventor: David F. May, Columbus, IN (US)

(73) Assignee: Analytical Engineering, Inc., Columbus, IN (US)

( * ) Notice: Subject to any disclaimer, the term of this patent is extended or adjusted under 35 U.S.C. 154(b) by 0 days.

(21) Appl. No.: 09/176,689

(22) Filed: Oct. 21, 1998

Related U.S. Application Data

(60) Provisional application No. 60/101,804, filed on Sep. 25, 1998.

(51) Int. Cl.[7] ..... B04B 9/06

(52) U.S. Cl. ..... 494/24; 494/36; 494/49; 494/84

(58) Field of Search ..... 494/24, 36, 43, 494/45, 49, 64, 84, 901, 73; 210/168, 171, 232, 354, 360.1, 380.1, 416.5; 184/6.24

(56) References Cited

U.S. PATENT DOCUMENTS

| | | | | |
|---|---|---|---|---|
| 2,053,856 | * | 9/1936 | Weidenbacker . | |
| 2,321,144 | * | 6/1943 | Jones | 494/49 |
| 2,335,420 | * | 11/1943 | Jones | 494/49 |
| 2,485,390 | * | 10/1949 | Langmuir | 494/49 |
| 3,273,324 | * | 9/1966 | Jennings | 494/49 |
| 3,335,946 | * | 8/1967 | Putterlik | 494/73 |
| 3,430,853 | * | 3/1969 | Kirk et al. | 494/49 |
| 3,791,576 | | 2/1974 | Bazil . | |
| 3,879,294 | * | 4/1975 | Ellis et al. . | |
| 4,106,689 | | 8/1978 | Kozulla . | |
| 4,142,671 | * | 3/1979 | Ivin et al. | 494/73 |
| 4,150,580 | | 4/1979 | Silkebakken et al. . | |
| 4,165,032 | * | 8/1979 | Klingenberg . | |
| 4,221,323 | * | 9/1980 | Courtot . | |
| 4,492,631 | * | 1/1985 | Martin | 494/901 |
| 4,557,831 | | 12/1985 | Lindsay et al. | 210/232 |
| 5,085,783 | | 2/1992 | Feke et al. . | |
| 5,637,217 | | 6/1997 | Herman et al. | 210/380.1 |
| 5,707,519 | * | 1/1998 | Miller et al. | 210/360.1 |
| 5,779,618 | | 7/1998 | Onodera et al. . | |
| 5,785,849 | * | 7/1998 | Mules | 494/36 |
| 6,017,300 | | 1/2000 | Herman | 494/49 |

FOREIGN PATENT DOCUMENTS

| | | | | |
|---|---|---|---|---|
| 1089355 | * | 11/1967 | (GB) | 494/49 |
| 362643 | * | 12/1972 | (SU) | 494/49 |
| 564884 | * | 7/1977 | (SU) | 494/49 |
| 869822 | * | 10/1981 | (SU) | 494/49 |
| 83/02406 | * | 7/1983 | (WO) | 494/49 |

* cited by examiner

*Primary Examiner*—Charles E. Cooley
(74) *Attorney, Agent, or Firm*—Taylor & Aust, P.C.

(57) ABSTRACT

A centrifugal filter assembly for filtering particulates from a fluid includes a rotating filter disposed within a housing and rotatable relative to the housing about an axis of rotation. A turbine is attached to the filter and includes a plurality of turbine blades extending generally radially relative to the axis of rotation. A nozzle having an outlet is aligned relative to the turbine, whereby a pressurized fluid which is jetted from the nozzle impinges upon the turbine and causes the filter to rotate about the axis of rotation.

4 Claims, 12 Drawing Sheets

TURBINE DRIVEN CENTRIFUGAL FILTER

CROSS REFERENCE TO RELATED APPLICATIONS

This is a non-provisional patent application based upon provisional patent application serial No. 60/101,804, entitled "AUXILIARY POWERED CENTRIFUGAL FILTER", filed Sep. 25, 1998.

BACKGROUND OF THE INVENTION

1. Field of the Invention

The present invention relates to centrifugal filters for filtering particulates from a liquid using centrifugal force.

2. Description of the Related Art

Many types of fluids contain particulates which need to be filtered out for subsequent use of the fluid. Examples of such fluids include medical and biological fluids, machining and cutting fluids, and lubricating oils. With particular reference to an internal combustion engine, a lubricating oil such as engine oil may contain particulates which are filtered out to prevent mechanical or corrosive wear of the engine.

Diesel engine mechanical wear, especially that relating to boundary lubricated wear, is a direct function of the amount of particulates in the lubricating oil. A particulate which is extremely detrimental to engine wear is soot, formed during the combustion process, and deposited into the crankcase through combustion gas blow-by and piston rings scraping of the cylinder walls. Soot is a carbonaceous polycyclic hydrocarbon which has extremely high surface area whereby it interacts chemically with adsorptive association with other lubricant species. Particle sizes of most diesel engine lubricant soot is between 100 Angstroms and 3 microns. Ranges of concentration are between 0 and 10 percent by weight depending on many factors. Because engine wear will dramatically increase with the soot level in the lubricating oil, engine manufacturers specify a certain engine drain oil interval to protect the engine from this type of mechanical wear. Current sieve type filters do not remove sufficient amounts of soot to provide soot related wear protection to the engine.

Centrifugal filters for lubricant filtration are generally known. Current production centrifugal lubricant oil filters are powered by hero turbines, which are part of the oil filter canister, or through direct mechanical propulsion. Hero turbine powered filters are limited by the supplied oil pressure from the engine, and only can be operated up to maximum speeds around 4000 revolutions per minute (RPM) with oil pressures nominally at less than 40 psi. In addition, hero turbine powered filters pass oil through the filter canister as it migrates toward the attached hero turbine jets. Therefore, the lubricant mean residence time is less than a few minutes. None of the currently available centrifugal filters which operate on the basis of a hero turbine provide satisfactory soot removal rates. Soot removal from engine lubricating oil requires greater G forces and longer residence times than is demonstrated with currently commercially available hero turbine powered filters.

Is also known to drive a centrifugal filter using a mechanical linkage from a turbine. The turbine receives a flow of engine exhaust air and drives a mechanical output shaft which nozzle impinges upon the turbine and causes the filter to rotate about the axis of rotation.

An advantage of the present invention is that the turbine is directly driven by a pressurized fluid to rotate the filter at a speed which is sufficient to effect centrifugal separation.

Another advantage is that the turbine is impacted upon by the pressurized fluid substantially orthogonal to the axis of rotation of the filter, thereby improving efficiency by substantially eliminating force vectors on the turbine parallel to the axis of rotation.

Yet another advantage is that the turbine may be configured as rigidly attached to, removably attached to or integral with the filter.

Still another advantage is that the nozzle may be disposed either radially within or outside of the turbine.

A further advantage is that the nozzle may be adjustably positioned relative to a fixed or variable geometry turbine.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

All of the units described above and others commercially available fall generally in groups of hero turbine design or direct mechanical actuation. While direct mechanically driven systems are capable of reaching the necessary G forces to provide soot removal, this type of linkage is generally very expensive and requires extensive modification of engines to adapt. While hero turbines do not suffer from this problem, insufficient G forces limit these filters from removing soot.

SUMMARY OF THE INVENTION

The present invention provides a centrifugal filter for filtering particulates from a liquid, wherein a turbine attached to a rotatable filter is driven with a pressurized fluid at a speed which is sufficient to separate the particulates from the liquid via centrifugal force.

Figure 2:
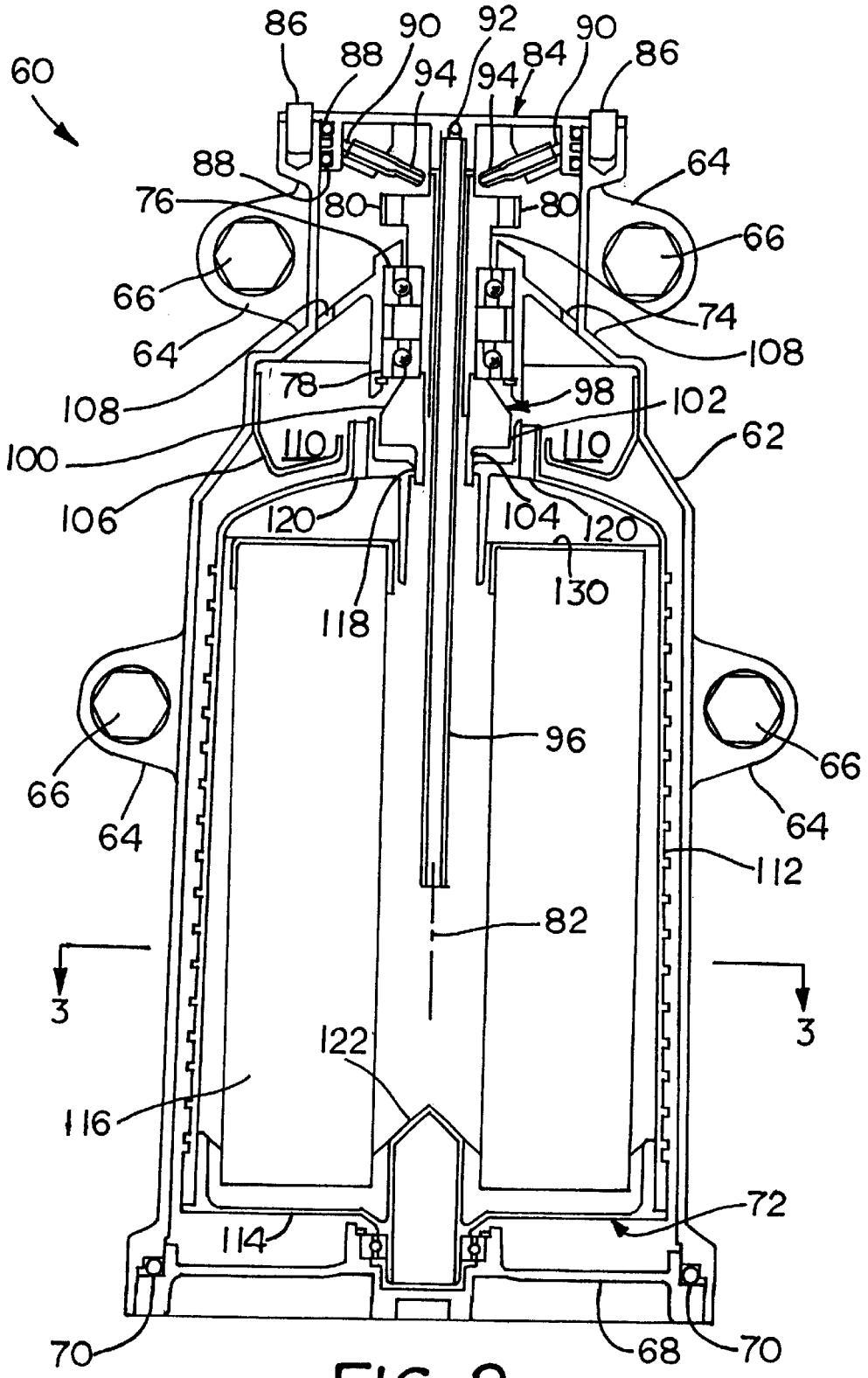
Figure 3:
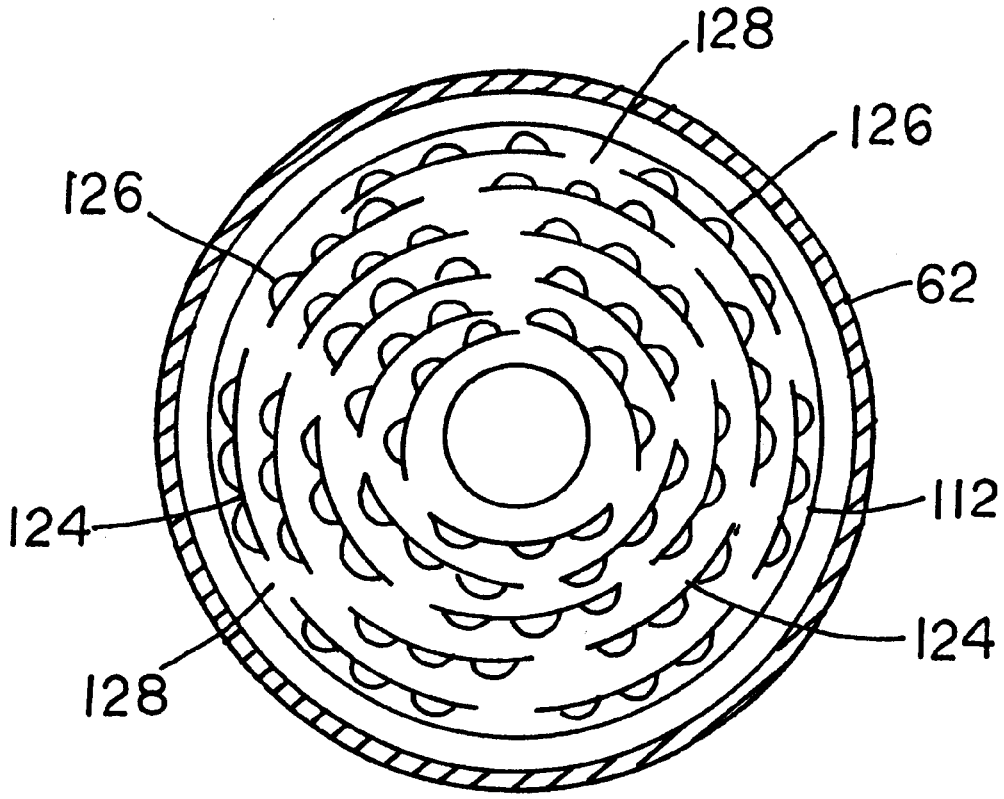
Figure 4:
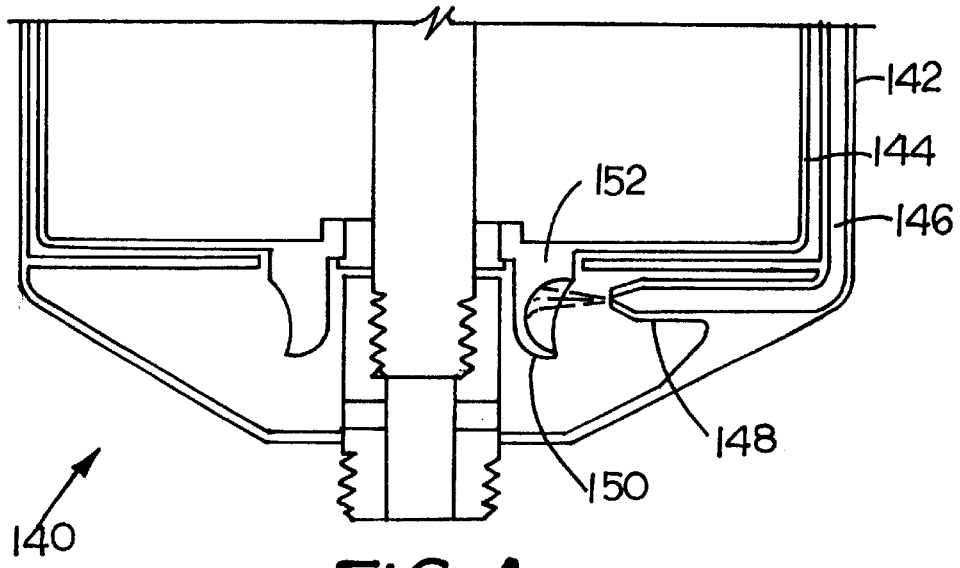
Figure 5:
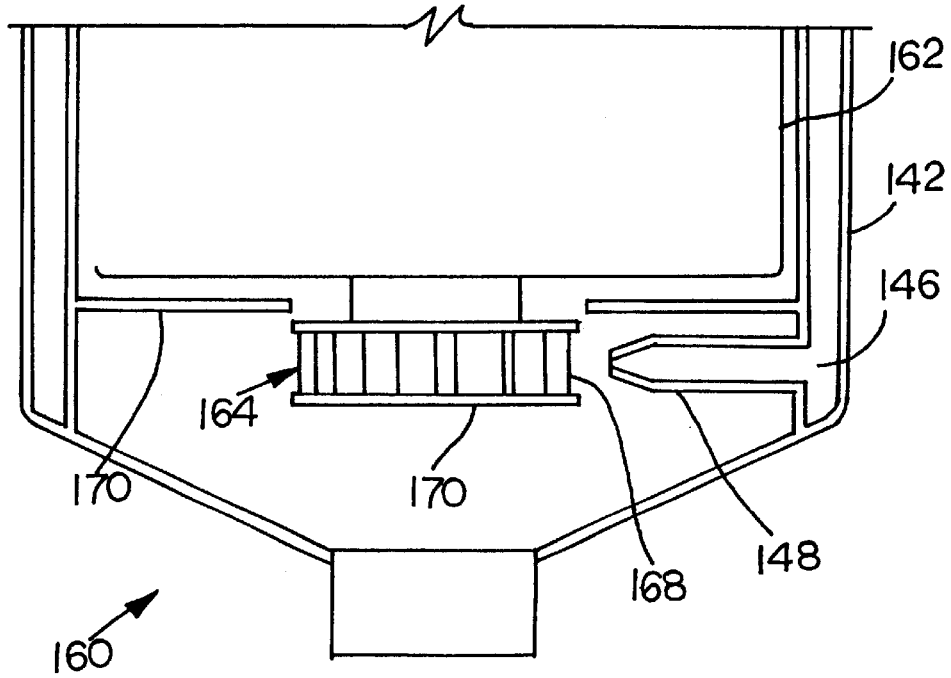
Figure 6:
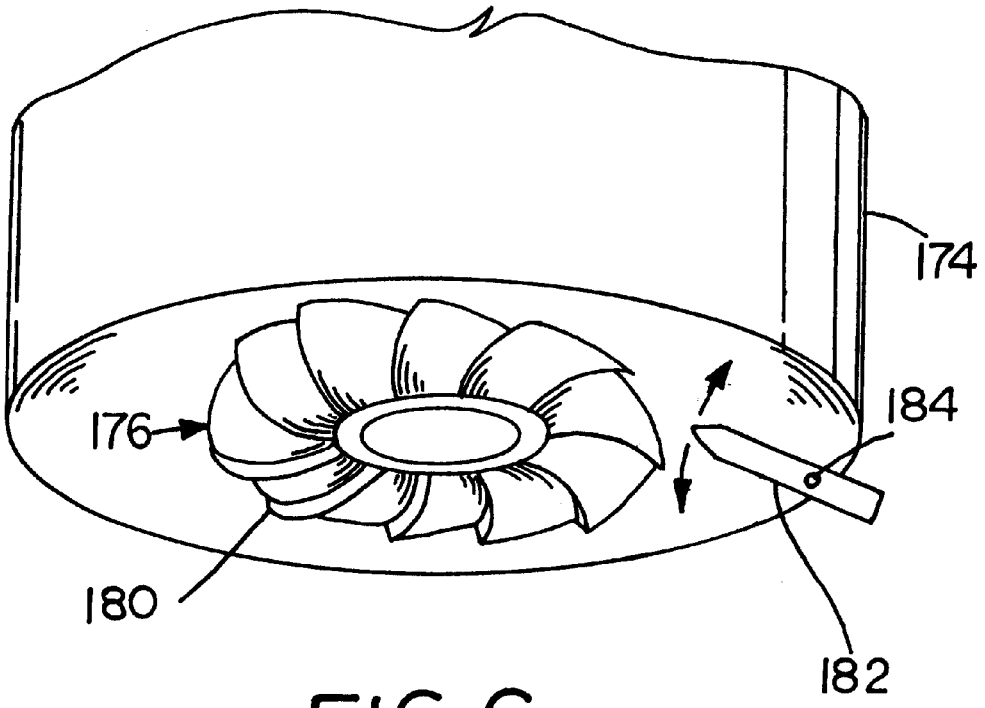
Figure 7:
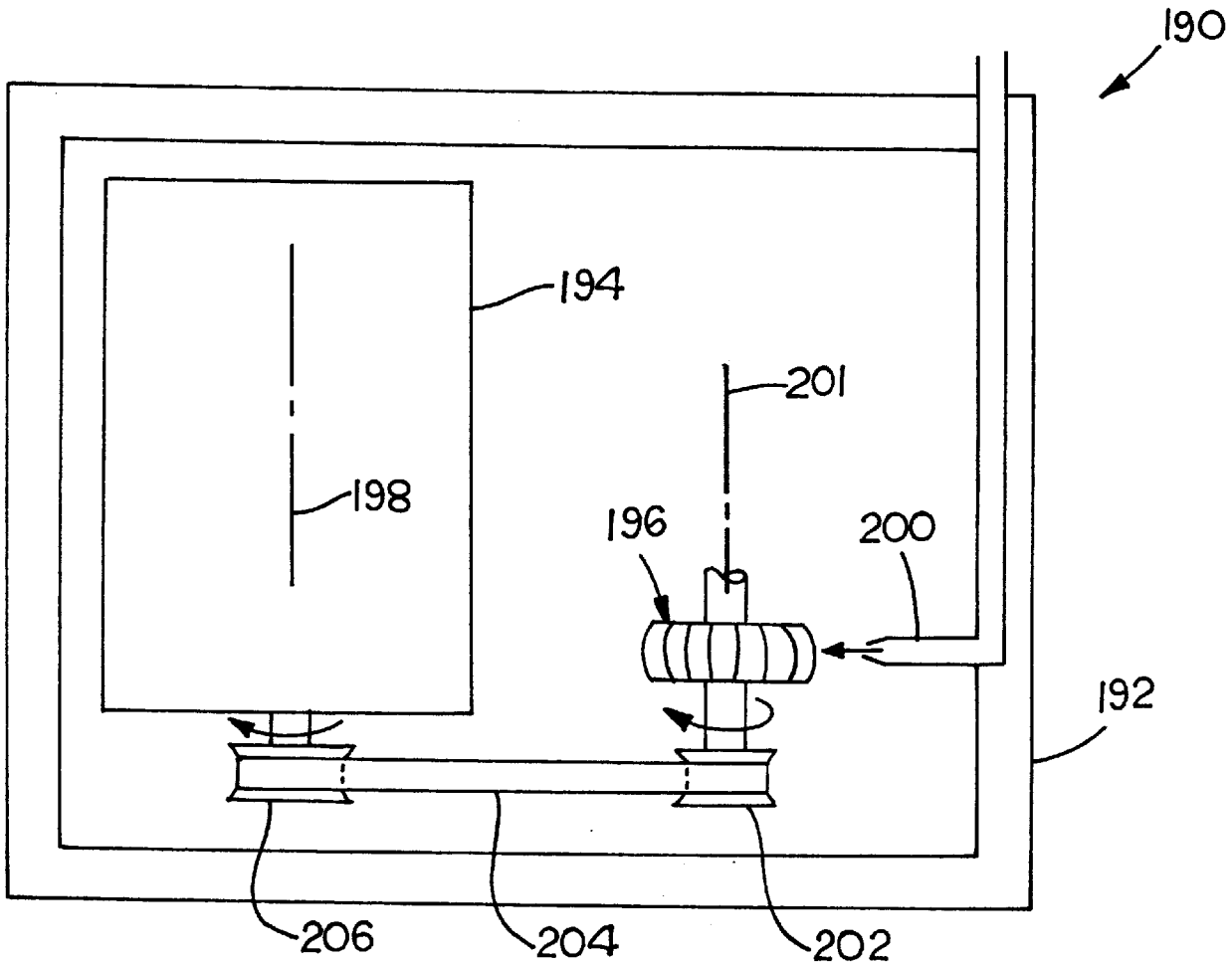
Figure 8:
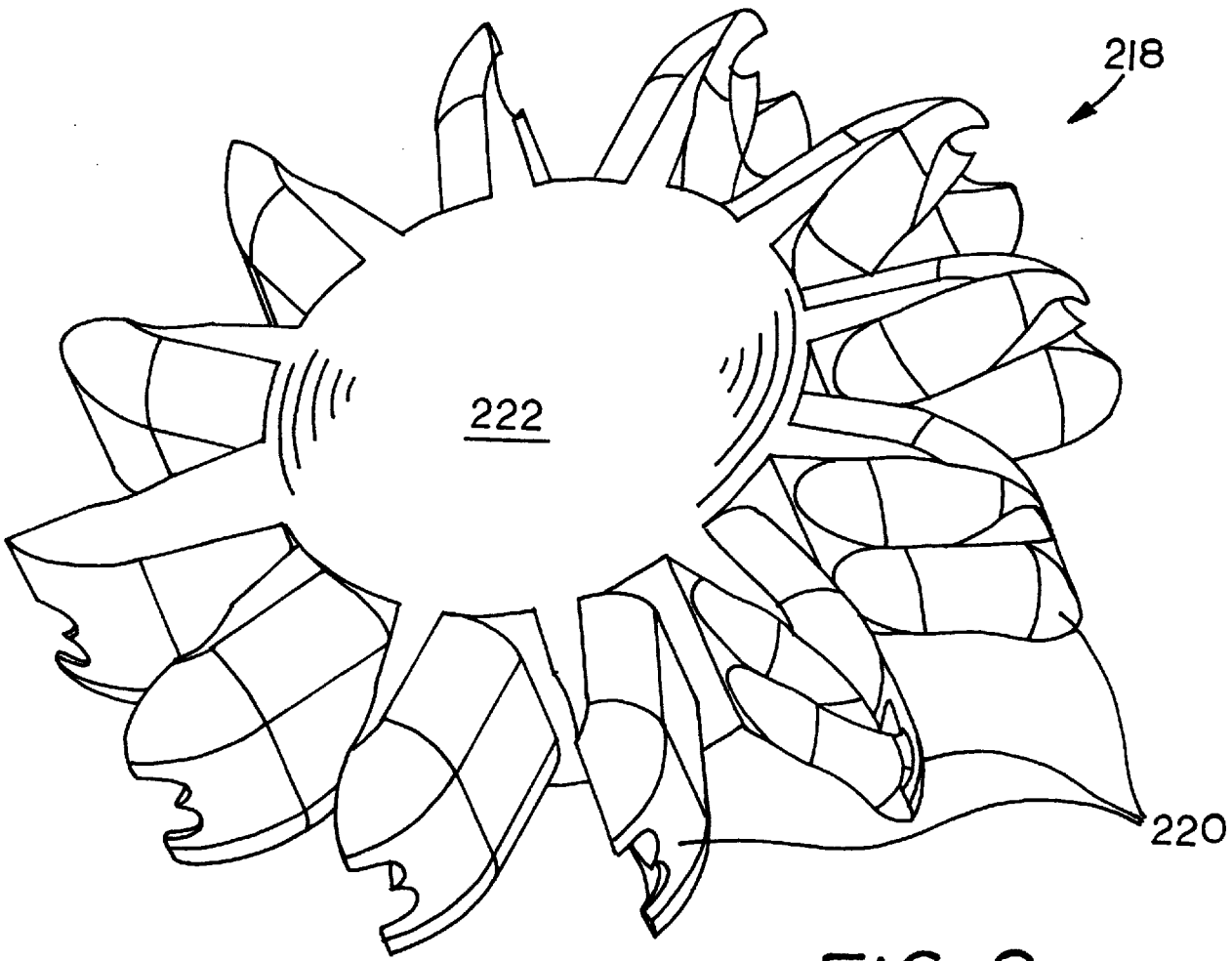
Figure 9:
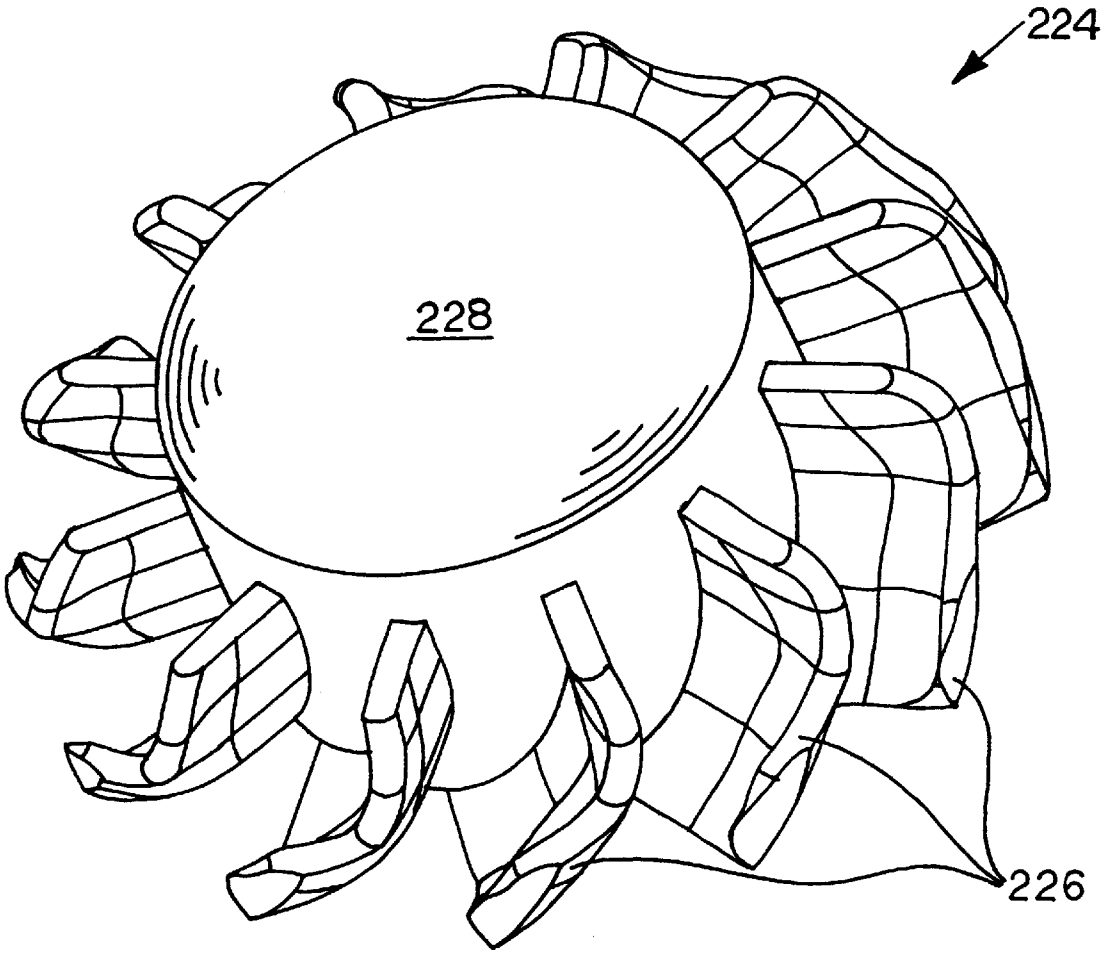
Figure 10:
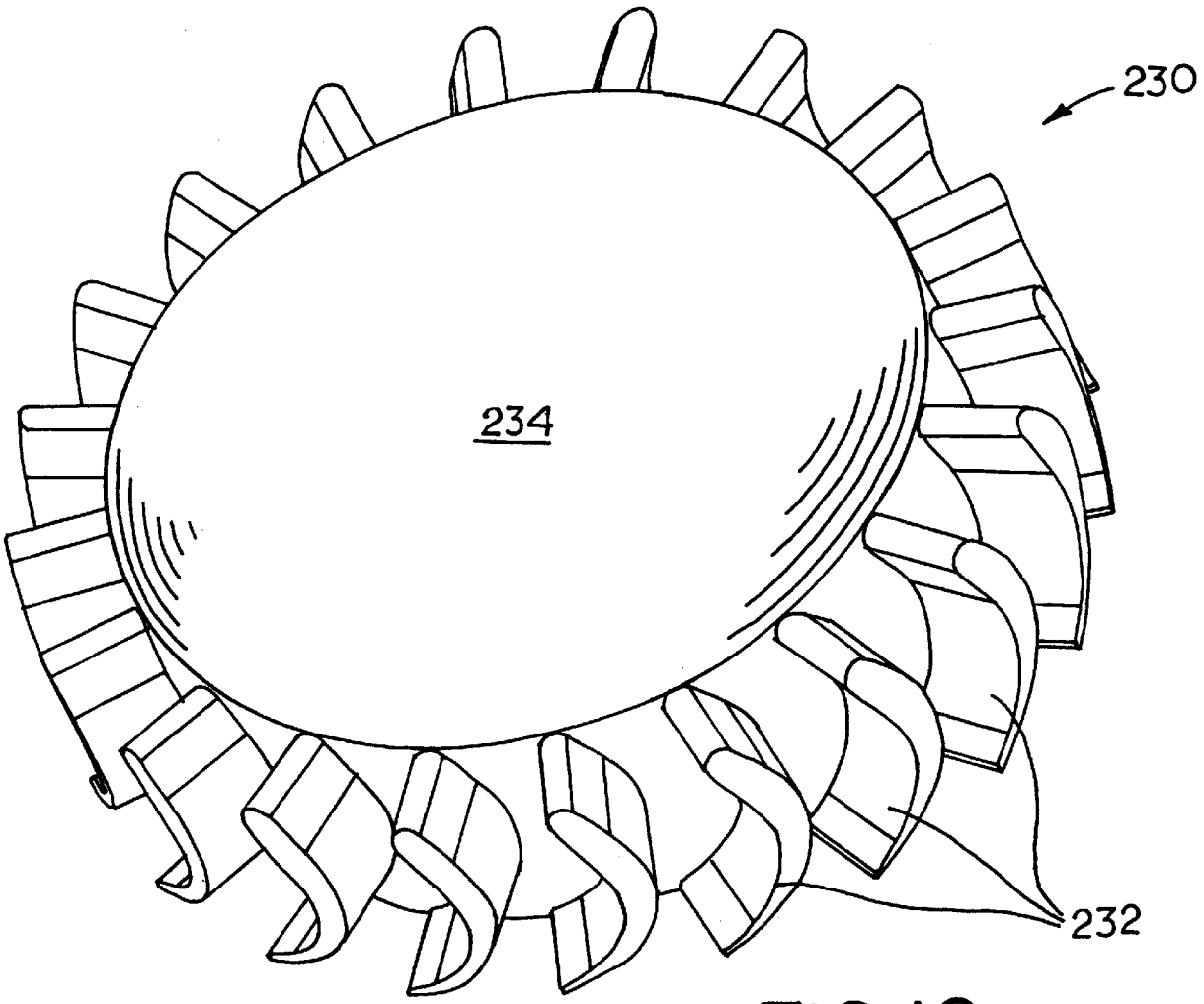
Figure 11:
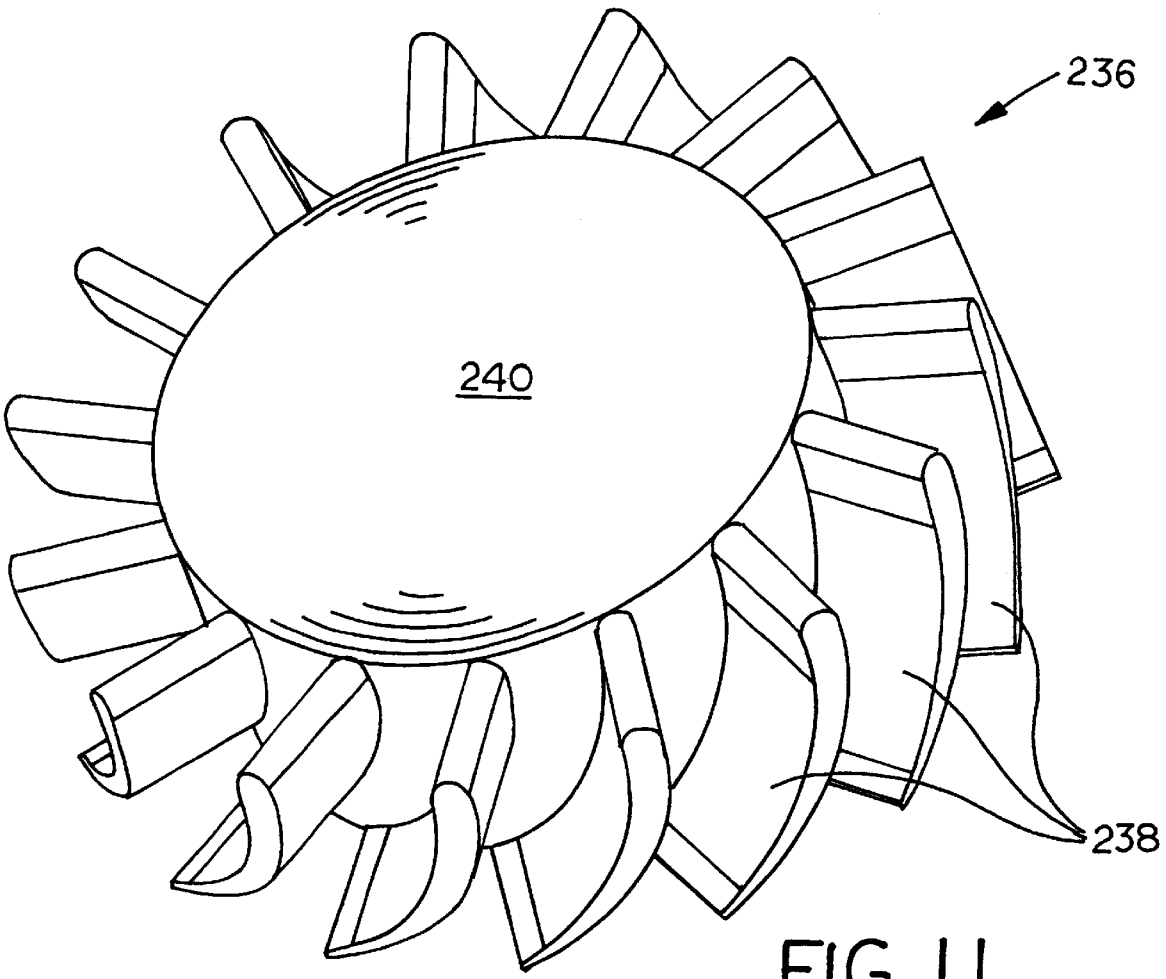
Figure 12:
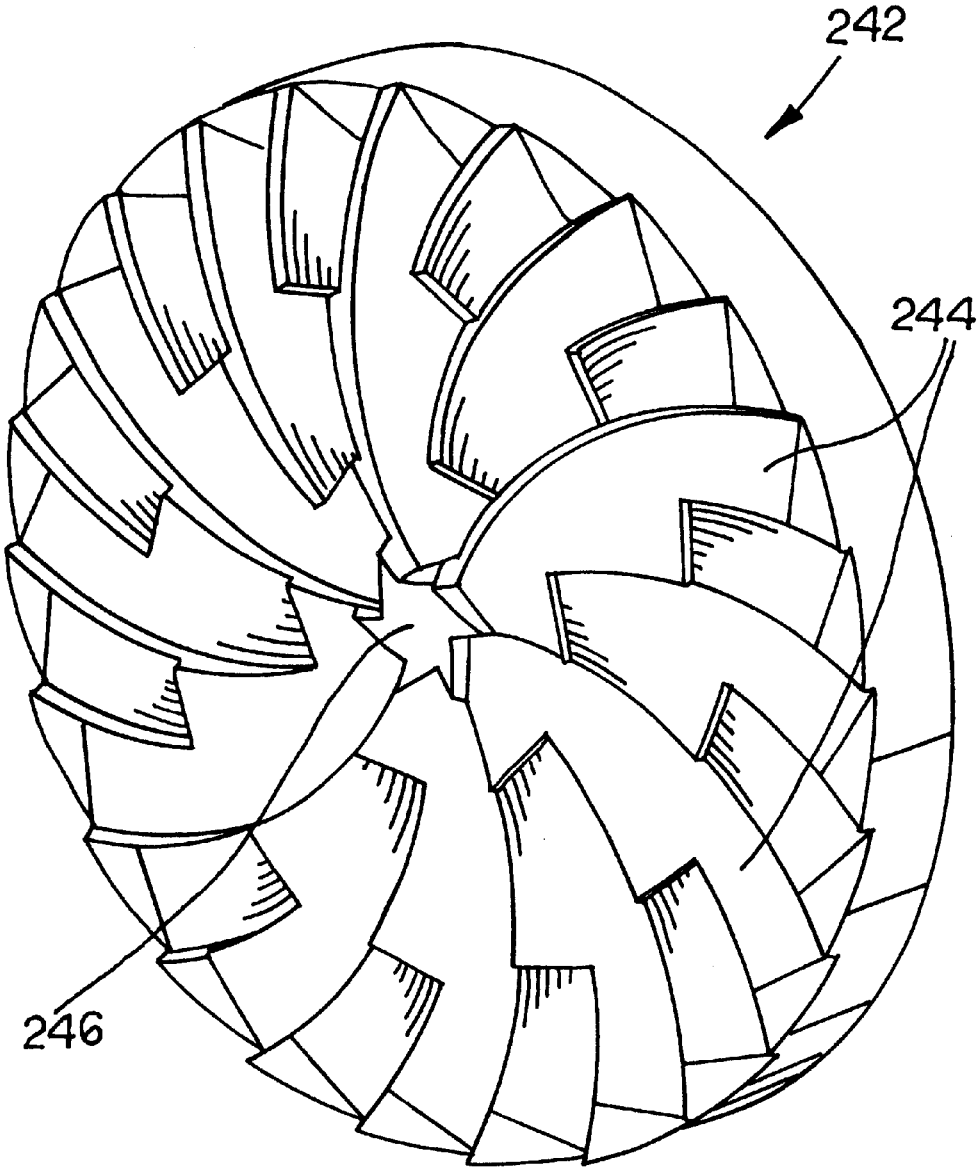
Figure 13:
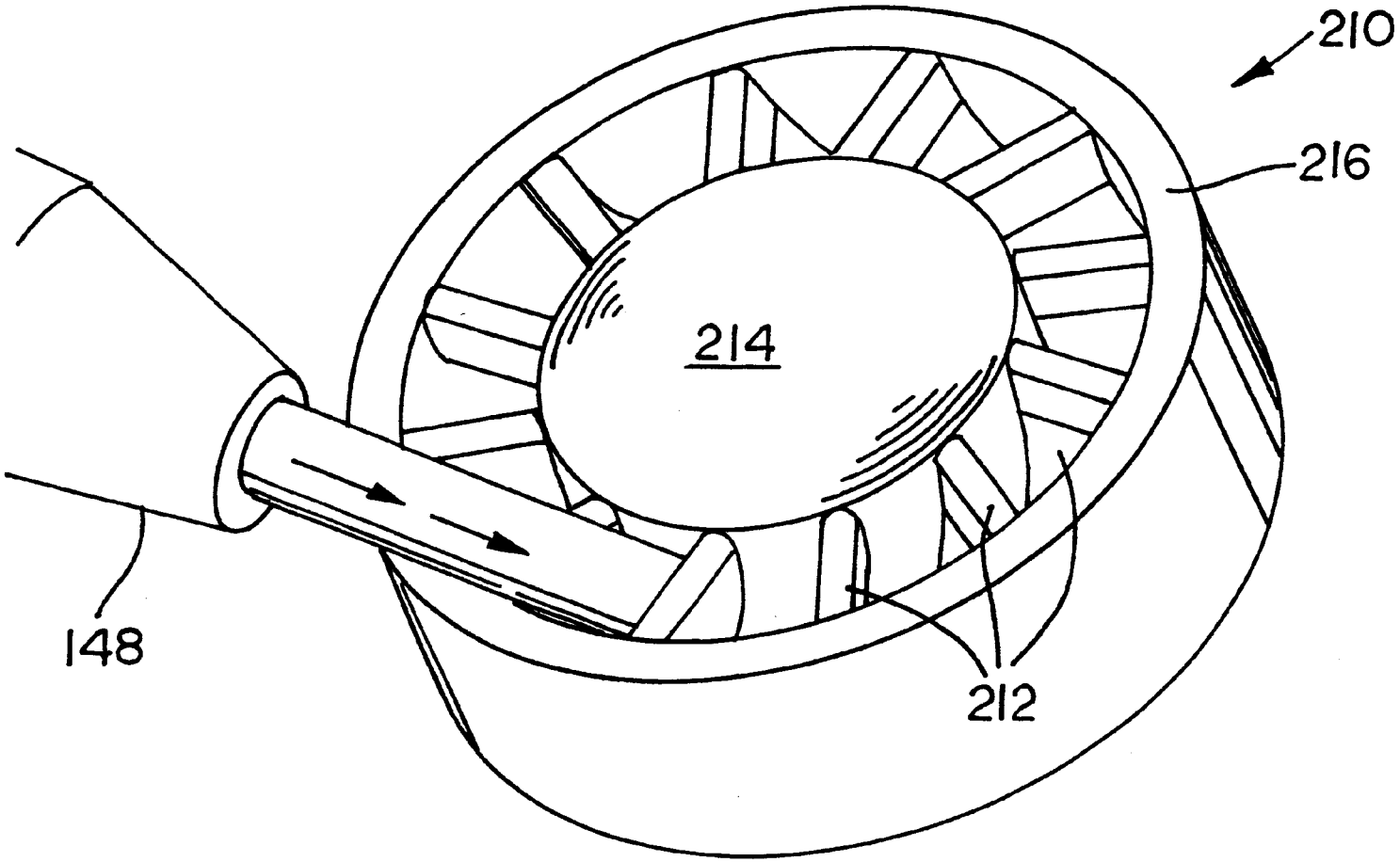

The invention comprises, in one form thereof, a centrifugal filter assembly for filtering particulates from a fluid. A rotating filter is disposed within a housing and rotatable relative to the housing about an axis of rotation. A turbine is connected to the filter and includes a plurality of turbine blades extending generally radially relative to the axis of rotation. A nozzle having an outlet is aligned relative to the turbine, whereby a pressurized fluid which is jetted from the FIG. 2 is a side, sectional view of another embodiment of a centrifugal filter assembly of the present invention;

FIG. 3 is a sectional view taken along line 3—3 in FIG. 2;

FIG. 4 is a fragmentary, side view of still another embodiment of a centrifugal filter assembly of the present invention;

FIG. 5 is a fragmentary, side view of another embodiment of a centrifugal filter assembly of the present invention;

FIG. 6 is a perspective view of an embodiment of a filter of the present invention;

FIG. 7 is a simplified, side view of still another embodiment of a centrifugal filter assembly of the present invention;

FIG. 8 is a perspective view of an embodiment of a turbine for use with the centrifugal filter assembly of the present invention;

FIG. 9 is a perspective view of another embodiment of a turbine for use with the centrifugal filter assembly of the present invention;

FIG. 10 is a perspective view of yet another embodiment of a turbine for use with the centrifugal filter assembly of the present invention;

FIG. 11 is a perspective view of still another embodiment of a turbine for use with the centrifugal filter assembly of the present invention;

FIG. 12 is a perspective view of a further embodiment of a variable geometry turbine for use with the centrifugal filter assembly of the present invention; and FIG. 13 is a perspective view of yet another embodiment of a turbine for use with the centrifugal filter assembly of the present invention.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
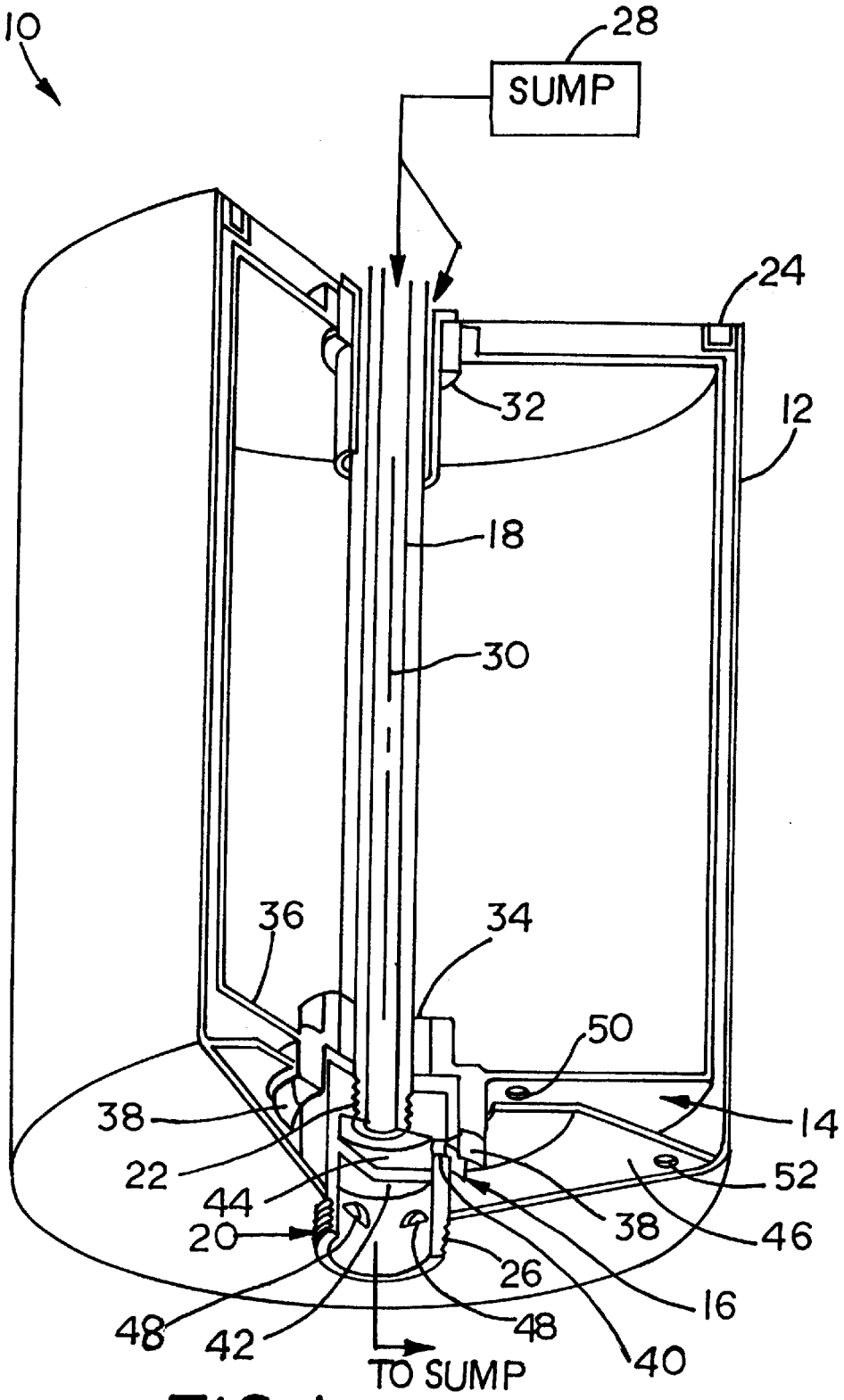
FIG. 1 is a perspective, sectional view of an embodiment of a centrifugal filter assembly of the present invention; in turn is coupled with a filter inside a centrifugal filter assembly. The rotational speed of the filter is sufficient to separate particulates within the engine oil. An example of such a filter is disclosed in U.S. Pat. No. 5,779,618 (Onodera, et al.).

Referring now to the drawings, and more particularly to FIG. 1, there is shown an embodiment of a centrifugal filter assembly 10 of the present invention for filtering particulates from a fluid. For example, centrifugal filter assembly 10 may be used to filter soot from engine oil in a diesel engine, and will be described accordingly. Centrifugal filter assembly 10 may be used for other applications, such as medical applications for separating particulates from a bodily or medical fluid, or machining and cutting applications for separating metallic particles from a hydraulic fluid or lubricating oil.

Centrifugal filter assembly 10 generally includes a housing 12, rotating filter 14 and turbine 16. Housing 12 contains filter 14 and defines a generally fluid-tight vessel. For example, housing 12 may be used as part of a bypass filter assembly for use with an internal combustion engine. When configured as such, a central supply tube 18 disposed in communication with a sump 28 extends outwardly from the engine. Housing 12 includes a hub 20 which is rigidly attached therewith. Hub 20 includes an internal threaded portion 22 which threadingly engages external threads on supply tube 18. Screwing hub 20 onto supply tube 18 causes housing 12 to axially seal against the engine. An annular seal 24 on an axial end face of housing 12 effects a fluid tight seal with the engine. Hub 20 includes external threads 26 allowing attachment with suitable fluid conduits (not shown) for recirculating oil transported through filter assembly 10 back to sump 28.

Filter 14 is disposed within and rotatable relative to housing 12 about an axis of rotation 30 defined by supply tube 18. Filter 14 may be rotatably carried using a pair of reduced friction bearings 32 and 34 disposed at each axial end thereof. Bearings 32 and 34 may be, e.g., roller bearings, ball bearings or another type of reduced friction bearing supports such as a bushing. Filter 14 may include a suitable medium therein (not shown) allowing filtration of the fluid which is transported through filter 14. For example, the medium disposed within filter 14 may be in the form of a spiral wrapped and embossed sheet of metal or plastic material, as will be described in greater detail hereinafter.

Turbine 16 is connected to filter 14 at an axial end thereof. In the embodiment shown, turbine 16 is attached to a bottom wall 36 of filter 14 via welding, a suitable adhesive or the like. The interconnection between turbine 16 and filter 14 causes rotation of turbine 16 to in turn rotate filter 14 about axis of rotation 30.

Turbine 16 includes a plurality of blades 38 which extend generally radially relative to axis of rotation 30. Blades 38 may extend substantially through axis of rotation 30, or may be positioned at an angle offset from axis of rotation 30. Moreover, blades 38 may be configured with a particular shape which is curved, straight, segmented, a combination of the same, etc., to provide a desired rotational speed of filter 14 during operation.

Hub 20 of housing 12 includes at least one fluid port 40 defining a nozzle through which a pressurized fluid is jetted to impact upon turbine blades 38. In the embodiment shown, hub 20 includes a single fluid port 40 defining a nozzle, although a greater number of fluid ports may also be provided. A wall 42 disposed within hub 20 defines a pressure chamber 44 in communication with each of an internal bore of supply tube 18 and fluid port 40. The pressurized fluid is transported through supply tube 18 into pressure chamber 44 and is jetted from fluid port 40. The pressurized fluid which is jetted from fluid port 40 sequentially impinges upon blades 38 of turbine 16. The pressurized fluid is jetted from fluid port 40 in a direction which is substantially perpendicular to axis of rotation 30, thereby eliminating force vectors in a direction parallel to axis of rotation 30 and maximizing the force imparted on each blade 38. The curvature and/or positioning of each blade 38 causes a rotational moment to be exerted on turbine 16, which in turn causes turbine 16 and filter 14 to rotate about axis of rotation 30.

A splash shield 46 is attached to housing 12 and is disposed radially around turbine 16 above blades 38. Pressurized fluid which is jetted radially outwardly from fluid port 40 against turbine blades 38 falls to a bottom of housing 12 and exits through drain holes 48 in hub 20. Splash shield 46 prevents an appreciable amount of pressurized fluid from spraying against a side wall of housing 12 and impacting against filter 14. Impact of the pressurized fluid would provide aerodynamic drag on filter 14 and slow the rotational speed thereof. A relatively small radial clearance is provided between turbine 16 and splash shield 46 to minimize the amount of pressurized fluid which flows past splash shield 46 to an area adjacent filter 14.

Filter 14 fills with oil to be filtered during operation. One or more exit holes 50 are provided in the bottom side of filter 14. The size and number of holes 50, as well as the fluid input rate into filter 14 is a function of the desired throughput rate through filter 14 and residence time of the fluid within filter 14. Engine oil which drains through holes 50 in the bottom of filter 14 flows down the top of splash shield 46, through one or more holes 52 in splash shield 46, and out through drain holes 48 in hub 20.

During use, a pressurized fluid is transported from sump 28 to supply tube 18. When used with an internal combustion engine, the pressurized fluid may be in the form of engine oil which is pressurized using an oil pump to a pressure of between 30 and 70 pound per square inch (psi), and more particularly approximately 45 psi. Approximately 90 percent (which actual percentage may vary) of the circulated engine oil is transported through supply tube 18 to pressure chamber 44 for discharging in a generally radially outward direction relative to axis of rotation 30 against turbine blades 38 of turbine 16. The pressurized engine oil causes turbine 16 to rotate at a speed of between approximately 5,000 and 20,000 revolutions per minute (RPM), more preferably between approximately 10,000 and 20,000 RPM. The remaining 10 percent of the engine oil is transported into filter 14 for centrifugal filtration. The high rotational speed of filter 14 creates a G force which is high enough to cause centrifugal separation of particulates carried within the engine oil. The particulates migrate radially outwardly within filter 14 and are contained within filter 14. Periodic changing of filter 14 allows the trapped particulates within filter 14 to be merely discarded along with filter 14.

Referring now to FIGS. 2 and 3, there is shown another embodiment of a centrifugal filter assembly 60 of the present invention. For purposes of illustration, centrifugal filter assembly 60 will be described for use with an internal combustion engine, but it is to be understood that filter assembly 60 may be utilized for other applications.

Housing 62 is attached to an engine (not shown) utilizing flanges 64 and bolts 66. A bottom cover 68 is threadingly engaged with housing 62 and is sealed with housing 62 using an annular O-ring 70. Bottom cover 68 may be removed from housing 62 to allow replacement of filter 72, as will be described in greater detail hereinafter.

Turbine 74 is rotatably carried by housing 62 using one or more reduced friction bearings, such as ball bearing assemblies 76 and 78. Turbine 74 includes a plurality of blades 80 disposed around the periphery thereof. Blades 80 extend generally radially relative to an axis of rotation 82, and have a selected shape to provide a desired rotational speed of turbine 74. The shape of blades 80 and the distance from axis of rotation 82 both have an effect on the rotational speed and are determined for a particular application (e.g., empirically).

A top cover 84 is fastened to housing 62 using, e.g., bolts 86. Seals such as O-rings 88 provide a fluid tight seal between top cover 84 and housing 62. Top cover 84 includes suitable porting 90 and 92 to be fluidly connected with a source of pressurized fluid and the fluid to be filtered, respectively. In the embodiment shown, porting 90 and 92 are each connected with a source of pressurized engine oil which provides both the source of pressurized fluid for rotating turbine 74 and the fluid to be filtered.

Nozzles 94 are attached to and carried by top cover 84, and direct a source of pressurized fluid at selected locations against blades 80 of turbine 74. As viewed in FIG. 2, the left hand nozzle 94 is disposed behind central supply tube 96 and the right hand nozzle 94 is disposed in front of supply tube 96. Nozzles 94 thus both jet a pressurized fluid which impinges upon blades 80 of turbine 74 on opposite sides of turbine 74. Because nozzles 94 are carried by top cover 84 and directed generally inwardly relative to axis of rotation 82, the specific impingement angle of the pressurized fluid on blades 80 can easily be adjusted for a specific application. The angle of impingement, flow velocity of the pressurized fluid, shape of blades 80 and impingement location relative to axis of rotation 82 may be configured to provide a desired rotational speed of turbine 74.

Drive nut 98 includes internal threads which are threadingly engaged with external threads of turbine 74. Drive nut 98 includes an upper, angled surface 100 defining a fluid port for providing lubricating oil to bearings 76 and 78. Drive nut 98 includes a lower drive portion 102 with a cross sectional shape which is other than circular (e.g., hexagonal). The shape of lower drive portion 102 allows turbine 74 to interconnect with filter 72 and rotatably drive filter 72 during use. A flange 104 extends from drive portion 102 and seals with filter 72 around the outer periphery thereof with a slight compression fit.

Splash shield 106 is attached with housing 62 and directs oil away from filter 72 which is used to drive turbine 74. Splash shield 106 is press fit into housing 62 in the embodiment shown. Pressurized fluid in the form of oil which is used to drive turbine 74 falls via gravitational force and flows through holes 108 and into a trough 110 defined by splash shield 106. The trough 110 is connected with an exit port (not shown) in housing 62 for recirculating the fluid to the sump of the engine.

Filter 72 generally includes a body 112, end cap 114 and impingement media 116. Body 112 includes a top opening 118 which surrounds and frictionally engages flange 104 of drive nut 98. The press fit between flange 104 and top opening 118 is sufficient to prevent fluid leakage therebetween. Body 112 also includes a plurality of exit holes, such as the two exit holes 120 in the top thereof. Exit holes 120 allow filtered oil to flow therethrough and into trough 110 during operation after filter 72 is full of the oil to be filtered.

End cap 114 is attached with body 112 in a suitable manner. In the embodiment shown, end cap 114 and body 112 are each formed from plastic and are ultrasonically welded together. However, it is also possible to attach end cap 114 with body 112 in a different manner, such as through a threaded or snap lock engagement. End cap 114 includes an upwardly projecting stud 122 with an angled distal face which acts to radially distribute oil to be filtered which is ejected from central supply tube 96.

Impingement media 116, shown in more detail in FIG. 3, is in the form of a long, continuous sheet 124 of material which is wrapped in a spiral manner about supply tube 96 and stud 122. Sheet 124 is formed with a plurality of randomly located dimples 126 which are approximately 3/16 inch diameter and 0.070 inch deep. Each dimple 126 defines a generally concave surface facing toward axis of rotation 82. Sheet 124 is approximately 0.020 inch thick and includes a plurality of holes 128 between dimples 126 which have a diameter of approximately 0.060 inch. Holes 128 are also substantially randomly placed on sheet 124 at locations between dimples 126 at a ratio of approximately one hole pre every three dimples. In the embodiment shown, dimples 126 have a center-to-center distance which varies, but with a mean center-to-center distance of approximately 5/8 inch. Of course, it will be appreciated that the specific geometry and number of dimples 126 and/or holes 128 within sheet 124 may vary depending upon the specific application.

Impingement media 116 in the form of a spiral wrapped sheet with dimples 126 and holes 128 provides effective centrifugal separation of particulates within the oil, and also regulates the residence time of the oil within filter 72. As filter 72 rotates at a desired rotational speed during use, the oil to be filtered is biased radially outwardly against an adjacent portion of sheet 124. Particulates within the oil settle into the concave surfaces defined by dimples 126 and the filtered oil migrates toward a hole 128 to pass therethrough in a radial direction and impinge upon the next radially outward portion of sheet 124. The radially outward flow of the oil through holes 128 in sheet 124 and trapping of particulates within dimples 126 continues until the filtered oil lies against the inside diameter of body 112. An annular cap 130 at the end of spiral wrapped sheet 124 prevents the oil from prematurely exiting in an axial direction toward the end of filter 72. The filtered oil flows in an upward direction along the inside diameter of body 112 and through exit holes 120 into trough 110 to be transported back to the sump of the engine.

FIG. 4 illustrates yet another embodiment of a centrifugal filter assembly 140 of the present invention. Filter assembly 140 includes a housing 142 with a filter 144 rotatably disposed therein. Housing 142 includes an integral fluid channel 146 which terminates at a nozzle 148. Nozzle 148 directs pressurized fluid against turbine blades 150 of turbine 152.

Filter 144 includes turbine 152 as an integral part thereof. That is, turbine 152 is monolithically formed with filter 144. In the embodiment shown, filter 144 and turbine 152 are each formed at the same time using a plastic injection molding process.

Referring now to FIG. 5, another embodiment of a centrifugal filter assembly 160 is shown, including a housing 142 and filter 162. Filter 162 includes a turbine 164 with a plurality of turbine blades 168. Turbine 164 includes a deflector shield 170 attached to an axial end thereof which maximizes the efficiency of the pressurized fluid jetted from nozzle 148 by confining sideways deflection of the fluid impinging on blades 168.

FIG. 6 illustrates another embodiment of a filter 174 which may be utilized with the centrifugal filter assembly of the present invention. Filter 174 includes a turbine 176 with a plurality of variable pitch turbine blades 180. A nozzle 182 which is attached with and pivotable relative to a housing (not shown) about a pivot point 184 is adjustable during use to change the impingement angle on blades 180 and the distance from the axis of rotation. The composite curved shape of each blade 180 coacts with the variable impingement angle from nozzle 182 to vary the rotational speed of and/or torque applied to turbine 176.

FIG. 7 illustrates yet another embodiment of a centrifugal filter assembly 190 of the present invention. Filter assembly 190 generally includes a housing 192, filter 194 and turbine 196. Filter 194 and turbine 196 are each disposed within housing 192 and are carried by suitable support structure (not shown) allowing rotation around respective axes of rotation 198 and 201. A nozzle 200 defined by housing 192 jets a flow of pressurized fluid onto turbine 196 to cause rotation thereof about axis of rotation 201. Rotation of turbine 196 in turn rotates pulley 202 which is connected via drive belt 204 with a pulley 206 rigidly attached to filter 194. Thus, rotation of turbine 196 causes rotation of filter 194 about axis of rotation 198. Using an elongate force transmission element, such as drive belt 204, allows the rotational speed of filter 194 to not only be adjusted by changing the physical configuration of turbine 196, but also by changing the diameters of the drive pulley 202 and driven pulley 206. For example, providing drive pulley 202 with a diameter which is the same as turbine 196 but twice as large as driven pulley 206 provides filter 194 with a rotational speed which is twice that of turbine 196.

FIGS. 8–12 illustrate perspective views of alternative embodiments of turbines which may be used in a centrifugal filter assembly of the present invention. The turbines shown in FIGS. 8–11 are fixed blade designs for use with a stationary nozzle, while the turbine shown in FIG. 12 is a variable geometry design for use with an adjustable nozzle. Turbine 218 (FIG. 8) includes a plurality of turbine blades 220 extending radially from a hub 222. Turbine 224 (FIG. 9) includes a plurality of turbine blades 226 extending radially from a hub 228. Turbine 230 (FIG. 10) includes a plurality of turbine blades 232 extending radially from a hub 234. Turbine 224 (FIG. 11) includes a plurality of turbine blades 238 extending radially from a hub 240. Lastly, Turbine 242 (FIG. 12) includes a plurality of turbine blades 224 extending radially from a hub 246.

FIG. 13 is a perspective view of yet another embodiment of a turbine 210 which may be utilized with a centrifugal filter assembly of the present invention. Turbine 210 includes a plurality of turbine blades 212 extending radially from a hub 214. A deflector shield 216 surrounds the periphery of turbine 210 and contacts blades 212. For example, deflector shield 216 may be press fit onto turbine 210 around the periphery of blades 212. Deflector shield 216 maximizes the efficiency of the pressurized fluid which is jetted from a nozzle 148 by confining radial deflections of the fluid impinging on blades 212.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A centrifugal filter assembly for filtering particulates from a fluid, comprising:

a housing;

a rotating filter disposed within said housing and rotatable relative to said housing about an axis of rotation, said filter being configured for containing the fluid therein and entrapping the particulates from the fluid, said filter including at least one impingement medium disposed therein, said impingement medium impinging a radially outward flow of the pressurized fluid to be filtered in a radial direction during rotation of the filter, said at least one impingement medium comprising a substantially continuous sheet of material wrapped in a spiral manner about said axis of rotation;

a turbine directly attached to said filter, said turbine including a plurality of turbine blades extending generally radially relative to said axis of rotation; and a nozzle having an outlet and being aligned relative to said turbine, whereby a pressurized fluid which is jetted from said nozzle impinges upon said turbine and causes said filter to rotate about said axis of rotation, thereby exerting a centrifugal force on the fluid contained within the filter, said centrifugal force biasing the particulates of the fluid against the filter.

2. The centrifugal filter assembly of claim 1, wherein said sheet of material includes a plurality of through holes.

3. A centrifugal filter assembly for filtering particulates from a fluid, comprising:

a housing;

a rotating filter disposed within said housing and rotatable relative to said housing about an axis of rotation, said filter including a sheet of material disposed therein and wrapped in a spiral manner about said axis of rotation, said sheet of material impinging a flow of the pressurized fluid to be filtered in a radial direction during rotation of the filter, said sheet of material including a plurality of dimples and a plurality of through holes;

a turbine connected to said filter, said turbine including a plurality of turbine blades extending generally radially relative to said axis of rotation; and a nozzle having an outlet and being aligned relative to said turbine, whereby a pressurized fluid which is jetted from said nozzle impinges upon said turbine and causes said filter to rotate about said axis of rotation.

4. The centrifugal filter assembly of claim 3, wherein each said dimple defines a generally concave surface facing toward said axis of rotation.

* * * * *